US010367285B2

(12) United States Patent
Wang et al.

(10) Patent No.: US 10,367,285 B2
(45) Date of Patent: Jul. 30, 2019

(54) FLEXIBLE CIRCUIT BOARD CONNECTOR

(71) Applicant: Cheng Uei Precision Industry Co., Ltd., New Taipei (TW)

(72) Inventors: Bin Wang, Dong-Guan (CN); Kun Du, Dong-Guan (CN)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 11 days.

(21) Appl. No.: 15/706,704

(22) Filed: Sep. 16, 2017

(65) Prior Publication Data

US 2019/0089079 A1 Mar. 21, 2019

(51) Int. Cl.

| | |
|---|---|
| ***H01R 12/57*** | (2011.01) |
| ***H01R 12/79*** | (2011.01) |
| ***H01R 12/88*** | (2011.01) |
| ***H01R 13/24*** | (2006.01) |

(52) U.S. Cl.

CPC ..... *H01R 12/79* (2013.01); *H01R 12/88* (2013.01); *H01R 13/24* (2013.01); *H01R 12/57* (2013.01)

(58) Field of Classification Search

CPC .... H01R 23/684; H01R 23/668; H01R 12/79; H01R 12/88; H01R 12/57; H01R 13/24

USPC ..... 439/260, 495

See application file for complete search history.

(56) References Cited

U.S. PATENT DOCUMENTS

| | | | | |
|---|---|---|---|---|
| 6,089,905 | A * | 7/2000 | Shimmyo | H01R 12/79 439/260 |
| 6,851,830 | B2 * | 2/2005 | Wu | F21S 8/065 362/376 |
| 7,192,295 | B1 * | 3/2007 | Yeh | H01R 13/6275 439/350 |
| 2006/0134953 | A1 * | 6/2006 | Williams | H05K 7/1411 439/157 |
| 2010/0159720 | A1 * | 6/2010 | Wang | H01R 13/447 439/76.1 |
| 2013/0109225 | A1 * | 5/2013 | Liu | H01R 24/64 439/492 |
| 2015/0171536 | A1 * | 6/2015 | Kameda | H01R 12/772 439/329 |

* cited by examiner

*Primary Examiner* — Gary F Paumen
(74) *Attorney, Agent, or Firm* — Cheng-Ju Chiang

(57) ABSTRACT

A flexible circuit board connector includes an insulating housing, a plurality of conductive terminals assembled to the insulating housing, an elastic module and a locking board. A front surface of the insulating housing is recessed rearward to form an inserting groove. The insulating housing opens an opening. The locking board accommodated in the opening has a base board. Two opposite sides of the base board extend downward to form two side boards. Bottom edges of the two side boards protrude downward to form two locking hooks. A flexible printed circuit board is inserted rearward into the inserting groove and pushes rearward against front surfaces of the two locking hooks, after the flexible printed circuit board slips away from the two locking hooks, the two locking hooks project into two gaps of the flexible printed circuit board, respectively.

20 Claims, 9 Drawing Sheets

FLEXIBLE CIRCUIT BOARD CONNECTOR

BACKGROUND OF THE INVENTION

1. Field of the Invention

The present invention generally relates to a connector, and more particularly to a flexible circuit board connector.

2. The Related Art

Generally, a flexible printed circuit (FPC) board has characteristics of better heat dissipation performance, being capable of bending freely and lighter weight. The flexible printed circuit boards have been widely used in electronic products including mobile computers, digital cameras, personal digital assistants (PDAs) and mobile phones. Each of the flexible printed circuit boards need make an electrical connection with corresponding components of one of the electronic products by virtue of a flexible circuit board connector. Conventionally, a gland structure or a drawer lock structure is applied to fasten the flexible printed circuit board in the flexible circuit board connector. When the flexible printed circuit board is assembled to the flexible circuit board connector, the gland structure or the drawer lock structure is opened manually, after the flexible printed circuit board is inserted into the flexible circuit board connector, the gland structure or the drawer lock structure is manually pressed in place for fastening the flexible printed circuit board in the flexible circuit board connector.

However, when the flexible printed circuit board is assembled to the flexible circuit board connector, the gland structure or the drawer lock structure need be opened manually, after the flexible printed circuit board is inserted into the flexible circuit board connector, the gland structure or the drawer lock structure is manually pressed in place, in that case, the flexible printed circuit board is easy to be out of place that causes the flexible printed circuit board to fall off. Moreover, the flexible printed circuit board is disadvantageous to be assembled to the flexible circuit board connector automatically, so a cost of the flexible printed circuit board being assembled to the flexible circuit board connector is higher.

SUMMARY OF THE INVENTION

An object of the present invention is to provide a flexible circuit board connector adapted for inserting a flexible printed circuit board into the flexible circuit board connector. Two opposite sides of a rear of the flexible printed circuit board open two gaps, respectively. The flexible circuit board connector includes an insulating housing, a plurality of conductive terminals assembled to the insulating housing, an elastic module assembled in the opening, and a locking board. A middle of a front surface of the insulating housing is recessed rearward to form an inserting groove. The insulating housing opens an opening penetrating through a middle of a top surface, a top of the front surface and a top of a rear surface of the insulating housing. Two opposite sides of the insulating housing open two receiving slots penetrated through the top surface of the insulating housing and communicated with the inserting groove. The two receiving slots are communicated with the inserting groove. The elastic module includes a pivoting rod, and at least one torsion spring pivotally mounted around the pivoting rod. The pivoting rod is assembled in the opening. A middle of the at least one torsion spring is pivotally mounted around the pivoting rod. The locking board is accommodated in the opening of the insulating housing and covers a top of the elastic module. So the at least one torsion spring of the elastic module is clamped between the insulating housing and the locking board to make the at least one torsion spring generate a precompression. The locking board is pivotally mounted to the pivoting rod. The locking board has a base board. Two opposite sides of the base board extend downward to form two side boards. Bottom edges of the two side boards protrude downward to form two locking hooks. The two side boards are received in the two receiving slots and project downward into the inserting groove. One end of the at least one torsion spring elastically abuts against a front of a bottom surface of the locking board, and the other end of the at least one torsion spring is disposed under a rear of the bottom surface of the locking board. The flexible printed circuit board is inserted rearward into the inserting groove, with the flexible printed circuit board being inserted rearward into the inserting groove, the flexible printed circuit board abuts against the two locking hooks, the flexible printed circuit board pushes rearward against front surfaces of the two locking hooks to make the locking board rotate, after the flexible printed circuit board slips away from the two locking hooks, the two locking hooks project into the two gaps of the flexible printed circuit board, respectively, and when the flexible printed circuit board moves frontward, the two locking hooks are capable of abutting against rear inner walls of the two gaps of the flexible printed circuit board respectively for blocking the flexible printed circuit board from moving frontward, so that the flexible printed circuit board is locked in the inserting groove.

Another object of the present invention is to provide a flexible circuit board connector. The flexible circuit board connector includes an insulating housing, a plurality of conductive terminals received in the inserting groove, a locking board and at least one torsion spring. The insulating housing has an inserting groove formed on a front surface of the insulating housing. At least two receiving slots are penetrated through a top surface of the insulating housing and communicated with the inserting groove. The locking board is pivotally mounted to the top surface of the insulating housing. The locking board has at least two locking hooks passing through the at least two receiving slots and projecting into the inserting groove. A front surface of each of the at least two locking hooks is inclined rearward from top to bottom. The at least one torsion spring is clamped between the insulating housing and the locking board to urge the locking hooks to project into the inserting groove.

As described above, before the flexible printed circuit board is inserted into the flexible circuit board connector, the two sides of the one end of the at least one torsion spring are elastically received in two first holding grooves respectively and elastically abut against a front of a bottom surface of the base board of the locking board, and a rear of the bottom surface of the base board of the locking board is located on a rear of a top surface of the bottom wall of the opening, so that the locking board is mounted to the insulating housing with a top surface of the locking board being flush with a top surface of the insulating housing. When the flexible printed circuit board is inserted into the flexible circuit board connector, with the flexible printed circuit board being inserted between upper ridges and lower ridges of the plurality of the conductive terminals, the flexible printed circuit board abuts against the two locking hooks of the two side boards of the locking board, the flexible printed circuit board pushes rearward against the front surfaces of the two locking hooks to make the locking board rotate, after the flexible printed circuit board slips away from the two locking hooks, the two locking hooks project into the two gaps of the flexible printed circuit board, respectively, and when the flexible printed circuit board moves frontward, the two locking hooks are capable of abutting against rear inner walls of the two gaps of the flexible printed circuit board respectively for blocking the flexible printed circuit board from moving frontward, at the moment, the flexible printed circuit board is inserted into the inserting groove of the flexible circuit board connector in place, so that the flexible printed circuit board is locked in the inserting groove of the flexible circuit board connector stably and easily. Moreover, the flexible printed circuit board is advantageous to be assembled to the flexible circuit board connector automatically, so a cost of the flexible printed circuit board being assembled to the flexible circuit board connector is lower.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
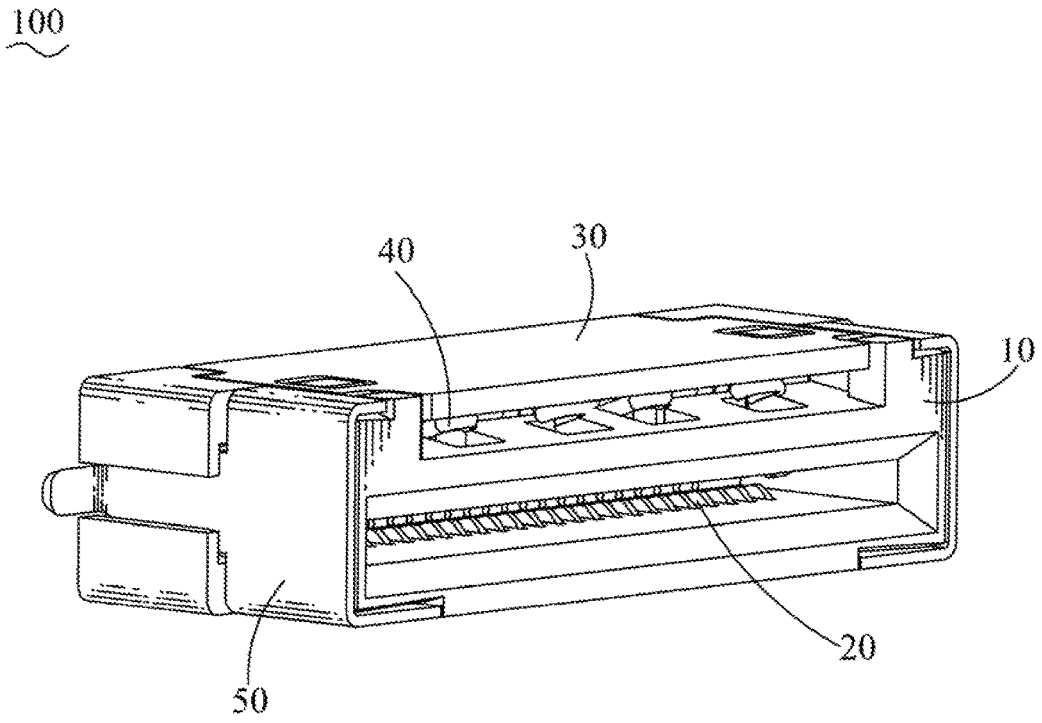
FIG. 1 is a perspective view of a flexible circuit board connector in accordance with the present invention.
Figure 2:
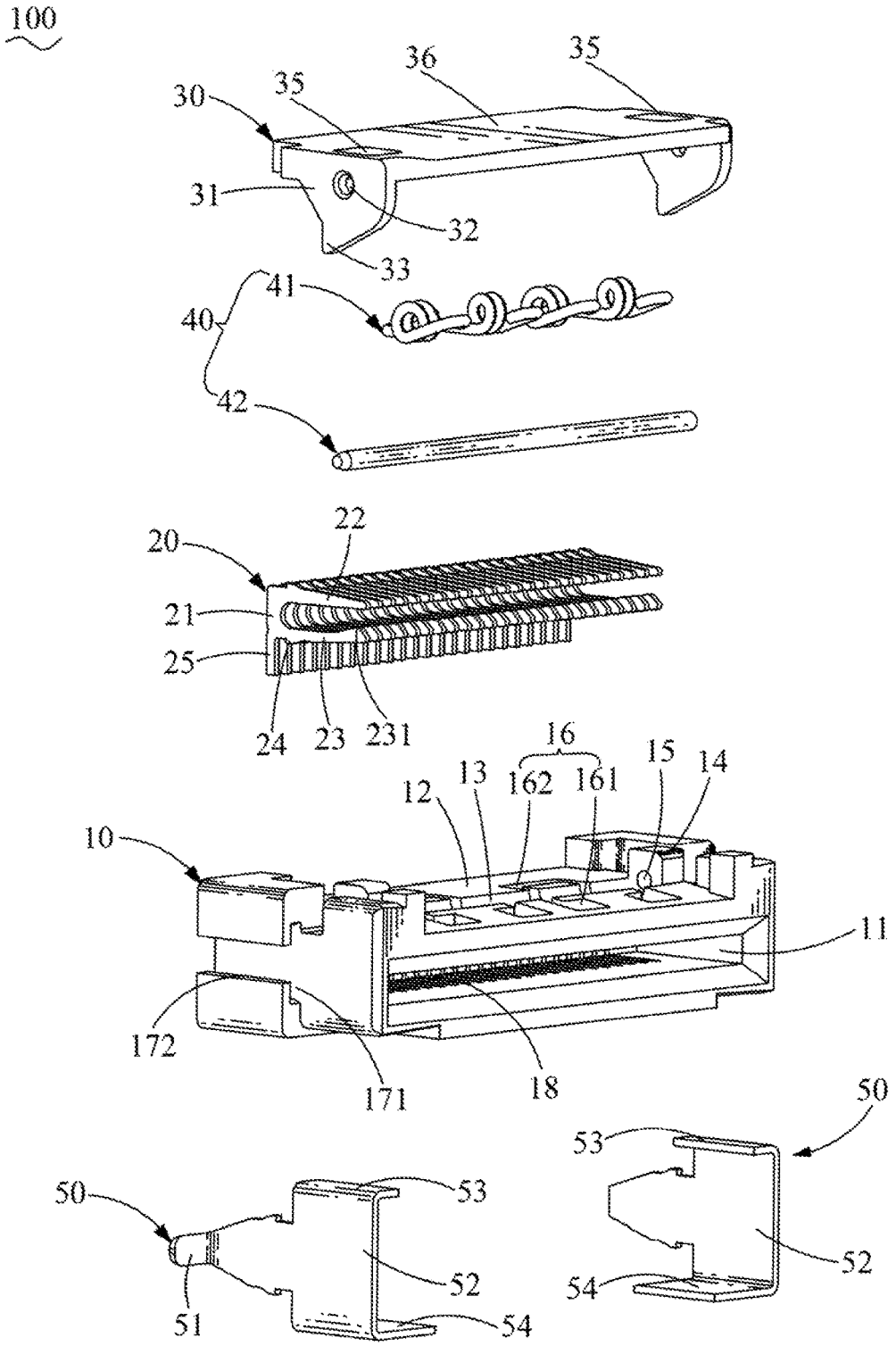
FIG. 2 is an exploded perspective view of the flexible circuit board connector of FIG. 1.
Figure 8:
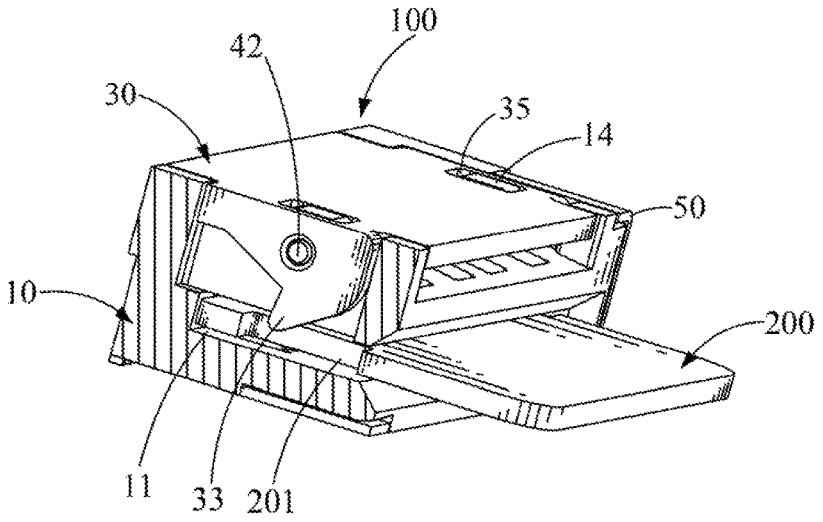
FIG. 8 is a perspective view of the flexible circuit board connector of FIG. 1, wherein the flexible printed circuit board is inserted into the flexible circuit board connector of FIG. 1 in place.
Figure 9:
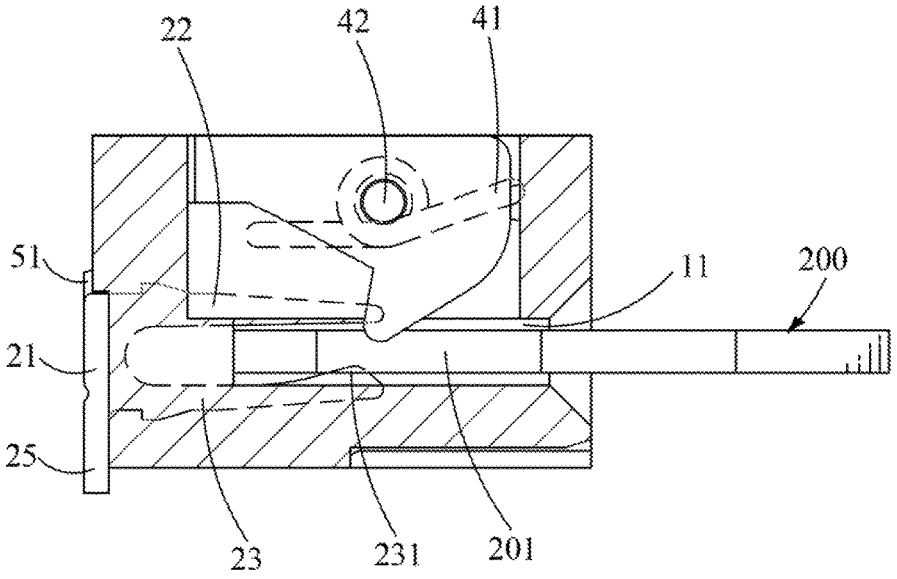
FIG. 9 is a partially sectional side view of the flexible circuit board connector of FIG. 8, wherein the flexible printed circuit board is inserted into the flexible circuit board connector of FIG. 8 in place.

With reference to FIG. 1, FIG. 2 and FIG. 8, a flexible circuit board connector 100 in accordance with a preferred embodiment of the present invention is shown. The flexible circuit board connector 100 is adapted for inserting a flexible printed circuit board 200 into the flexible circuit board connector 100. A direction of the flexible printed circuit board 200 being inserted into the flexible circuit board connector 100 is defined as a front-to-rear direction. Two opposite sides of a rear of the flexible printed circuit board 200 open two gaps 201, respectively. The flexible circuit board connector 100 includes an insulating housing 10, a plurality of conductive terminals 20 assembled to the insulating housing 10, a locking board 30, an elastic module 40 and two buckling elements 50.

Figure 6:
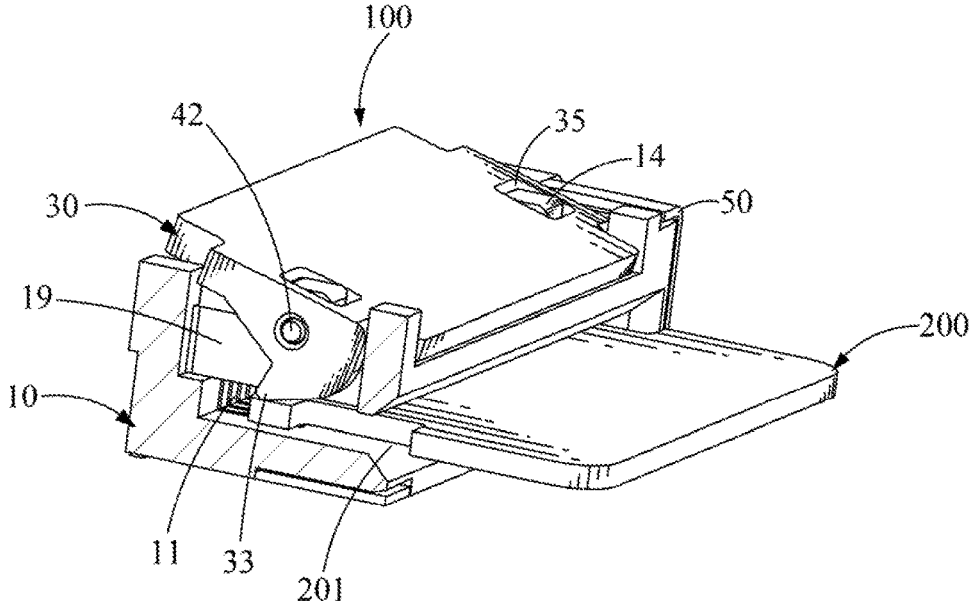
FIG. 6 is a perspective view of the flexible circuit board connector of FIG. 1, wherein a flexible printed circuit board is inserted into the flexible circuit board connector of FIG. 1.
Figure 7:
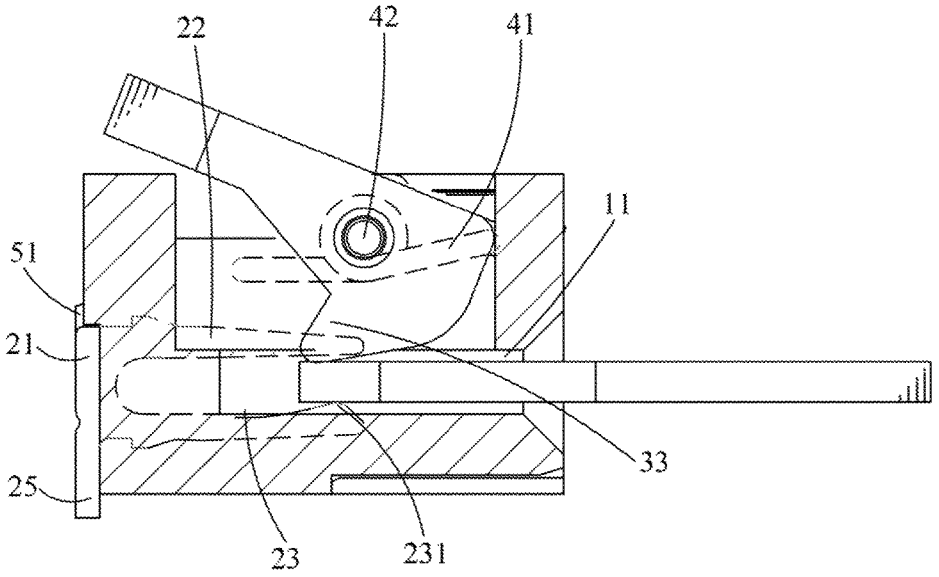
FIG. 7 is a partially sectional side view of the flexible circuit board connector of FIG. 6, wherein the flexible printed circuit board is inserted into the flexible circuit board connector of FIG. 1.

Referring to FIG. 2 and FIG. 6, the insulating housing 10 is of a rectangular board shape. The insulating housing 10 has an inserting groove 11 formed on a front surface of the insulating housing 10. A middle of the front surface of the insulating housing 10 is recessed rearward to form the inserting groove 11. A top surface of the insulating housing 10 forms a concave portion. The insulating housing 10 opens an opening 12 penetrating through a middle of the top surface, a top of the front surface and a top of a rear surface of the insulating housing 10. The concave portion is the opening 12. A middle of a top surface of a bottom wall of the opening 12 is recessed downward to form a long and narrow lower accommodating groove 13 extending transversely. Two opposite sides of the top surface of the bottom wall of the opening 12 protrude upward to form two protruding blocks 14. The lower accommodating groove 13 is located between the two protruding blocks 14. Middles of the two protruding blocks 14 open two circular pivoting holes 15 extending transversely.

The top surface of the insulating housing 10 opens at least one holding groove 16. The bottom wall of the opening 12 opens the at least one holding groove 16. The at least one holding groove 16 includes two first holding grooves 161 located in front of the lower accommodating groove 13, and an inverted U-shaped second holding groove 162 located behind the lower accommodating groove 13. Preferably, the bottom wall of the opening 12 opens two holding grooves 16. Each of the holding grooves 16 includes the two first holding grooves 161 located in front of the lower accommodating groove 13, and the inverted U-shaped second holding groove 162 located behind the lower accommodating groove 13. Two free ends of the inverted U-shaped second holding groove 162 penetrate through a front surface of a rear wall of the lower accommodating groove 13. Two portions of a front of the lower accommodating groove 13 extend frontward and then extend towards each other to form the two first holding grooves 161. The two first holding grooves 161 are communicated with the second holding groove 162 by the lower accommodating groove 13 to form the at least one holding groove 16.

Two opposite sides of the insulating housing 10 define two first fastening grooves 171 extending longitudinally and penetrating through the front surface and the rear surface of the insulating housing 10. Upper portions of fronts of the two first fastening grooves 171 extend upward to two opposite sides of the top surface of the insulating housing 10, respectively. Lower portions of the fronts of the two first fastening grooves 171 extend downward to two opposite sides of a bottom surface of the insulating housing 10, respectively. Middles of rears of the two first fastening grooves 171 extend outward to form two second fastening grooves 172 penetrating through the rear surface and middles of two side surfaces of the insulating housing 10, and front surfaces of outer walls of the two first fastening grooves 171.

The insulating housing 10 opens a plurality of substantially lying U-shaped terminal grooves 18 communicated with the inserting groove 11. Each of the terminal grooves 18 penetrates rearward through the rear surface of the insulating housing 10 and extends longitudinally along inner surfaces of a top wall and a bottom wall of the inserting groove 11. The insulating housing 10 has at least two receiving slots 19 penetrated through the top surface of the insulating housing 10 and communicated with the inserting groove 11. The two opposite sides of the insulating housing 10 open two receiving slots 19 penetrated through the top surface of the insulating housing 10 and communicated with the inserting groove 11. The two protruding blocks 14 and the lower accommodating groove 13 are located between the two receiving slots 19.

Referring to FIG. 2, each of the plurality of the conductive terminals 20 has a fastening portion 21. A top end and a bottom end of the fastening portion 21 of each of the plurality of the conductive terminals 20 extend frontward to form an upper ridge 22 and a lower ridge 23. A tail end of a top surface of the lower ridge 23 protrudes upward towards the upper ridge 22 to form a contact point 231. Root ends of a top surface of the upper ridge 22 and a bottom surface of the lower ridge 23 protrude oppositely to form two barbs 24, respectively. The bottom end of the fastening portion 21 of each of the plurality of the conductive terminals 20 extends downward to form a soldering portion 25.

Figure 3:
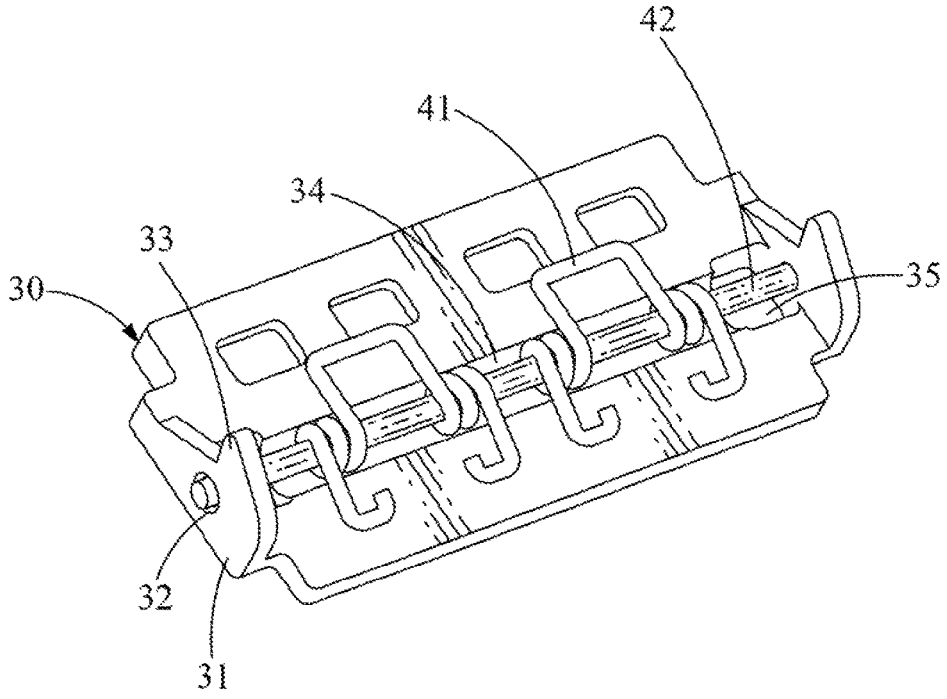
FIG. 3 is a partially perspective view of the flexible circuit board connector of FIG. 1, wherein an elastic module of the flexible circuit board connector of FIG. 1 is assembled to a locking board of the flexible circuit board connector of FIG. 1.
Figure 4:
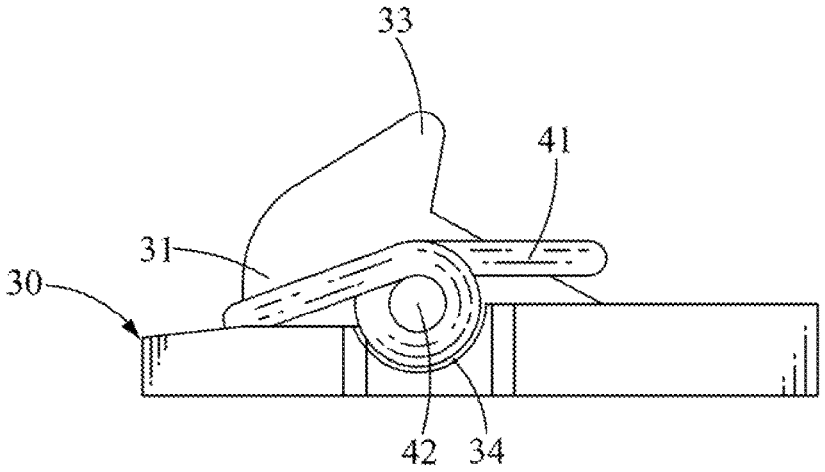
FIG. 4 is a partially side view of the flexible circuit board connector of FIG. 3, wherein the elastic module is assembled to the locking board.
Figure 5:
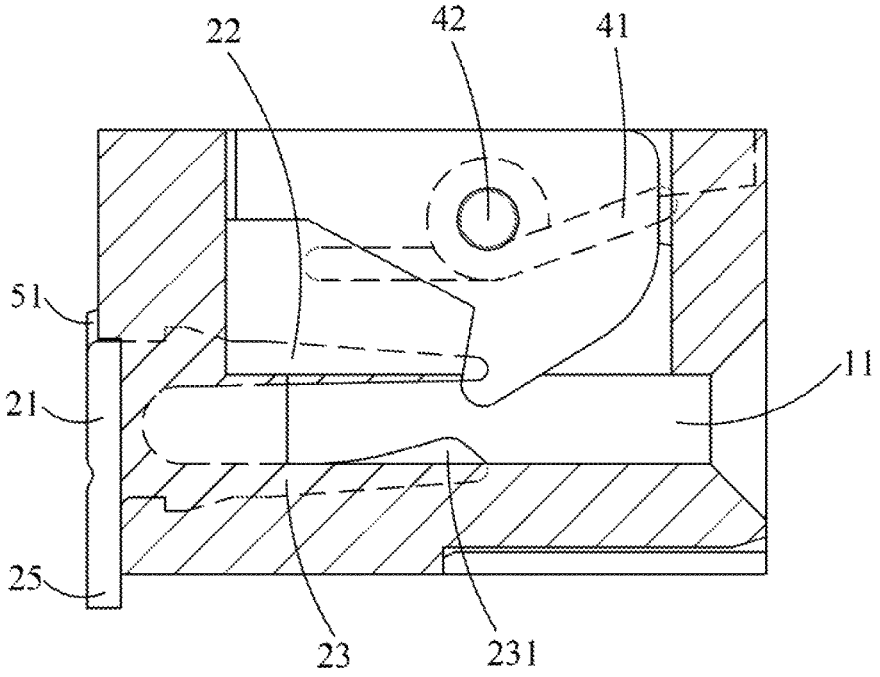
FIG. 5 is a partially sectional side view of the flexible circuit board connector of FIG. 1.

Referring to FIG. 2 and FIG. 3, the locking board 30 has a base board 36 of a substantially rectangular board shape. Two opposite sides of the base board 36 extend downward to form two side boards 31. Middles of the two side boards 31 open two perforations 32, respectively. The locking board 30 has at least two locking hooks 33. A front surface of each of the at least two locking hooks 33 is inclined rearward from top to bottom. Bottom edges of the two side boards 31 protrude downward to form two locking hooks 33. Front surfaces of the two locking hooks 33 are inclined rearward from top to bottom. Preferably, upper portions and lower portions of the front surfaces of the two locking hooks 33 are shown as arc-shaped cambers. An upper portion of a rear surface of each of the two locking hooks 33 is inclined rearward along the front-to-rear direction. A lower portion of the rear surface of each of the two locking hooks 33 extends vertically. A middle of a bottom surface of the base board 36 is recessed inward to form a long and narrow upper accommodating groove 34 extending transversely. Two opposite sides of the bottom surface of the base board 36 are recessed inward to form two avoiding grooves 35.

Referring to FIG. 2, the elastic module 40 includes a pivoting rod 42, and at least one torsion spring 41 pivotally mounted around the pivoting rod 42. Preferably, the elastic module 40 includes two torsion springs 41 pivotally mounted around the pivoting rod 42.

Referring to FIG. 2, each of the two buckling elements 50 has a base plate 52 of a plate shape. Rear edges of the two base plates 52 of the two buckling elements 50 are bent outward and perpendicular to the two base plates 52 of the two buckling elements 50 to form two soldering plates 51, respectively. Top edges of the two base plates 52 of the two buckling elements 50 are bent towards each other to form two first bending plates 53. Bottom edges of the two base plates 52 of the two buckling elements 50 are bent towards each other to form two second bending plates 54.

Referring to FIG. 1 to FIG. 5, when the flexible circuit board connector 100 is assembled, the plurality of the conductive terminals 20 are assembled to the terminal grooves 18 of the insulating housing 10. The plurality of conductive terminals 20 are received in the inserting groove 11. The upper ridge 22 and the lower ridge 23 of each of the plurality of the conductive terminals 20 project into the inserting groove 11. The contact point 231 projects into the inserting groove 11. The two barbs 24 of each of the plurality of the conductive terminals 20 interfere with inner surfaces of a top wall and a bottom wall of one of the terminal grooves 18, so that each of the plurality of the conductive terminals 20 is stably fastened in the one of the terminal grooves 18. The fastening portion 21 of each of the plurality of the conductive terminals 20 projects beyond the rear surface of the insulating housing 10. The soldering portion 25 of each of the plurality of the conductive terminals 20 projects beyond the rear surface of the insulating housing 10.

The concave portion is for receiving the locking board 30 and the at least one torsion spring 41. The elastic module 40 is assembled in the opening 12 of the insulating housing 10. The pivoting rod 42 is assembled in the opening 12 and is accommodated in the lower accommodating groove 13. Two opposite ends of the pivoting rod 42 are pivotally assembled to the pivoting holes 15 of the two protruding blocks 14. The two opposite ends of the pivoting rod 42 pass through and project out of the pivoting holes 15 of the two protruding blocks 14. A middle of the at least one torsion spring 41 is pivotally mounted around the pivoting rod 42. At least one portion of the at least one torsion spring 41 is received in the at least one holding groove 16. Two sides of one end of the at least one torsion spring 41 are elastically received in the two first holding grooves 161 respectively and elastically abut against a front of a bottom surface of the locking board 30, and the other end of the at least one torsion spring 41 is accommodated in the second holding groove 162 and disposed under a rear of the bottom surface of the locking board 30. Specifically, the two sides of the one end of the at least one torsion spring 41 are elastically received in the two first holding grooves 161 respectively and elastically abut against a front of the bottom surface of the base board 36 of the locking board 30. The other end of the at least one torsion spring 41 is accommodated in the second holding groove 162 and disposed under a rear of the bottom surface of the base board 36 of the locking board 30. A middle of each of the two torsion springs 41 is pivotally mounted around the pivoting rod 42. The two sides of the one end of each of the two torsion springs 41 are elastically received in the two first holding grooves 161 respectively and elastically abut against the front of the bottom surface of the base board 36 of the locking board 30. The other end of each of the two torsion springs 41 is accommodated in the second holding groove 162 and disposed under the rear of the bottom surface of the base board 36 of the locking board 30.

The locking board 30 is pivotally mounted to the top surface of the insulating housing 10, the at least two locking hooks 33 pass through the at least two receiving slots 19 and project into the inserting groove 11. The locking board 30 is accommodated in the opening 12 of the insulating housing 10 and covers a top of the elastic module 40. So the at least one torsion spring 41 of the elastic module 40 is clamped between the insulating housing 10 and the locking board 30 to make the at least one torsion spring 41 generate a precompression. The at least one torsion spring 41 is clamped between the insulating housing 10 and the locking board 30 to urge the locking hooks 33 to project into the inserting groove 11. The two opposite ends of the pivoting rod 42 projecting out of the pivoting holes 15 pass through the two perforations 32 of the two side boards 31 respectively to make that the locking board 30 is pivotally mounted to the pivoting rod 42, so that the locking board 30 is rotatably assembled in the opening 12 of the insulating housing 10. The two side boards 31 are received in the two receiving slots 19 and project downward into the inserting groove 11. The upper accommodating groove 34 is corresponding to the lower accommodating groove 13. So the pivoting rod 42 is accommodated between the upper accommodating groove 34 and the lower accommodating groove 13. The two avoiding grooves 35 are corresponding to the two protruding blocks 14, respectively. The two protruding blocks 14 are received in the two avoiding grooves 35, respectively.

The two buckling elements 50 are fastened in the two first fastening grooves 171, respectively. The two base plates 52 of the two buckling elements 50 are fastened in middles of the two first fastening grooves 171, respectively. The two soldering plates 51 of the two buckling elements 50 project beyond the rear surface of the insulating housing 10 through the two second fastening grooves 172, respectively. Rear surfaces of the soldering portions 25 of the plurality of the conductive terminals 20 are flush with rear surfaces of the two soldering plates 51 of the two buckling elements 50. The two first bending plates 53 of the two buckling elements 50 are assembled in the upper portions of the fronts of the two first fastening grooves 171, respectively. The two second bending plates 54 of the two buckling elements 50 are assembled in the lower portions of the fronts of the two first fastening grooves 171, respectively.

Referring to FIG. 1 to FIG. 5, before the flexible printed circuit board 200 is inserted into the flexible circuit board connector 100, the locking board 30 is accommodated in the opening 12. An upper half of the pivoting rod 42 is accommodated in the upper accommodating groove 34. A lower half of the pivoting rod 42 is accommodated in the lower accommodating groove 13. The at least one torsion spring 41 is pivotally mounted around the pivoting rod 42, and is located at a loosened status, the two sides of the one end of the at least one torsion spring 41 are elastically received in the two first holding grooves 161 respectively and elastically abut against the front of the bottom surface of the base board 36 of the locking board 30, and the rear of the bottom surface of the base board 36 of the locking board 30 is located on a rear of the top surface of the bottom wall of the opening 12, so that the locking board 30 is mounted to the insulating housing 10, and a top surface of the locking board 30 is flush with the top surface of the insulating housing 10. The other end of the at least one torsion spring 41 is accommodated in the second holding groove 162. The two protruding blocks 14 are received in the two avoiding grooves 35, respectively.

Referring to FIG. 1 to FIG. 9, when the flexible printed circuit board 200 is inserted rearward into the flexible circuit board connector 100, the flexible printed circuit board 200 is inserted rearward into the inserting groove 11 and between the upper ridges 22 and the lower ridges 23 of the plurality of the conductive terminals 20. With the flexible printed circuit board 200 being inserted rearward into the inserting groove 11 and between the upper ridges 22 and the lower ridges 23 of the plurality of the conductive terminals 20, the flexible printed circuit board 200 abuts against the two locking hooks 33 of the two side boards 31 of the locking board 30. The flexible printed circuit board 200 pushes rearward against the front surfaces of the two locking hooks 33 to make the locking board 30 rotate, after the flexible printed circuit board 200 slips away from the two locking hooks 33, the two locking hooks 33 project into the two gaps 201 of the flexible printed circuit board 200, respectively, and when the flexible printed circuit board 200 moves frontward, the two locking hooks 33 are capable of abutting against rear inner walls of the two gaps 201 of the flexible printed circuit board 200 respectively for blocking the flexible printed circuit board 200 from moving frontward, at the moment, the flexible printed circuit board 200 is inserted into the inserting groove 11 of the flexible circuit board connector 100 in place, so that the flexible printed circuit board 200 is locked in the inserting groove 11 of the flexible circuit board connector 100 stably and easily.

As described above, before the flexible printed circuit board 200 is inserted into the flexible circuit board connector 100, the two sides of the one end of the at least one torsion spring 41 are elastically received in the two first holding grooves 161 respectively and elastically abut against the front of the bottom surface of the base board 36 of the locking board 30, and the rear of the bottom surface of the base board 36 of the locking board 30 is located on the rear of the top surface of the bottom wall of the opening 12, so that the locking board 30 is mounted to the insulating housing 10 with the top surface of the locking board 30 being flush with the top surface of the insulating housing 10. When the flexible printed circuit board 200 is inserted into the flexible circuit board connector 100, with the flexible printed circuit board 200 being inserted between the upper ridges 22 and the lower ridges 23 of the plurality of the conductive terminals 20, the flexible printed circuit board 200 abuts against the two locking hooks 33 of the two side boards 31 of the locking board 30, the flexible printed circuit board 200 pushes rearward against the front surfaces of the two locking hooks 33 to make the locking board 30 rotate, after the flexible printed circuit board 200 slips away from the two locking hooks 33, the two locking hooks 33 project into the two gaps 201 of the flexible printed circuit board 200, respectively, and when the flexible printed circuit board 200 moves frontward, the two locking hooks 33 are capable of abutting against rear inner walls of the two gaps 201 of the flexible printed circuit board 200 respectively for blocking the flexible printed circuit board 200 from moving frontward, at the moment, the flexible printed circuit board 200 is inserted into the inserting groove 11 of the flexible circuit board connector 100 in place, so that the flexible printed circuit board 200 is locked in the inserting groove 11 of the flexible circuit board connector 100 stably and easily. Moreover, the flexible printed circuit board 200 is advantageous to be assembled to the flexible circuit board connector 100 automatically, so a cost of the flexible printed circuit board 200 being assembled to the flexible circuit board connector 100 is lower.

What is claimed is:

1. A flexible circuit board connector adapted for inserting a flexible printed circuit board into the flexible circuit board connector, two opposite sides of a rear of the flexible printed circuit board opening two gaps, respectively, the flexible circuit board connector comprising:

an insulating housing, a middle of a front surface of the insulating housing being recessed rearward to form an inserting groove, the insulating housing opening an opening penetrating through a middle of a top surface, a top of the front surface and a top of a rear surface of the insulating housing, two opposite sides of the insulating housing opening two receiving slots penetrated through the top surface of the insulating housing and communicated with the inserting groove, the two receiving slots being communicated with the inserting groove;

a plurality of conductive terminals assembled to the insulating housing;

an elastic module assembled in the opening, the elastic module including a pivoting rod, and at least one torsion spring pivotally mounted around the pivoting rod, the pivoting rod being assembled in the opening, a middle of the at least one torsion spring being pivotally mounted around the pivoting rod; and a locking board being accommodated in the opening of the insulating housing and covering a top of the elastic module, so the at least one torsion spring of the elastic module being clamped between the insulating housing and the locking board to make the at least one torsion spring generate a precompression, the locking board being pivotally mounted to the pivoting rod, the locking board having a base board, two opposite sides of the base board extending downward to form two side boards, bottom edges of the two side boards protruding downward to form two locking hooks, the two side boards being received in the two receiving slots and projecting downward into the inserting groove;

wherein one end of the at least one torsion spring elastically abuts against a front of a bottom surface of the locking board, the other end of the at least one torsion spring is disposed under a rear of the bottom surface of the locking board, the flexible printed circuit board is inserted rearward into the inserting groove, with the flexible printed circuit board being inserted rearward into the inserting groove, the flexible printed circuit board abuts against the two locking hooks, the flexible printed circuit board pushes rearward against front surfaces of the two locking hooks to make the locking board rotate, after the flexible printed circuit board slips away from the two locking hooks, the two locking hooks project into the two gaps of the flexible printed circuit board, respectively, and when the flexible printed circuit board moves frontward, the two locking hooks are capable of abutting against rear inner walls of the two gaps of the flexible printed circuit board respectively for blocking the flexible printed circuit board from moving frontward, so that the flexible printed circuit board is locked in the inserting groove.

2. The flexible circuit board connector as claimed in claim 1, wherein the insulating housing opens a plurality of terminal grooves communicated with the inserting groove, each of the terminal grooves penetrates rearward through the rear surface of the insulating housing and extends longitudinally along inner surfaces of a top wall and a bottom wall of the inserting groove, each of the plurality of the conductive terminals has a fastening portion, a top end and a bottom end of the fastening portion extend frontward to form an upper ridge and a lower ridge, the bottom end of the fastening portion extends downward to form a soldering portion, the plurality of the conductive terminals are assembled to the terminal grooves, the upper ridge and the lower ridge project into the inserting groove, the soldering portion projects beyond the rear surface of the insulating housing.

3. The flexible circuit board connector as claimed in claim 2, wherein the flexible printed circuit board is inserted between the upper ridges and the lower ridges of the plurality of the conductive terminals.

4. The flexible circuit board connector as claimed in claim 2, wherein a tail end of a top surface of the lower ridge protrudes upward towards the upper ridge to form a contact point, the contact point projects into the inserting groove.

5. The flexible circuit board connector as claimed in claim 2, wherein root ends of a top surface of the upper ridge and a bottom surface of the lower ridge protrude oppositely to form two barbs, respectively, the two barbs of each of the plurality of the conductive terminals interfere with inner surfaces of a top wall and a bottom wall of one of the terminal grooves, so that each of the plurality of the conductive terminals is stably fastened in the one of the terminal grooves.

6. The flexible circuit board connector as claimed in claim 2, further comprising two buckling elements, each of the two buckling elements having a base plate of a plate shape, the two opposite sides of the insulating housing defining two first fastening grooves extending longitudinally and penetrating through the front surface and the rear surface of the insulating housing, the two buckling elements being fastened in the two first fastening grooves, respectively, the two base plates of the two buckling elements being fastened in middles of the two first fastening grooves, respectively.

7. The flexible circuit board connector as claimed in claim 6, wherein top edges of the two base plates of the two buckling elements are bent towards each other to form two first bending plates, bottom edges of the two base plates of the two buckling elements are bent towards each other to form two second bending plates, upper portions of fronts of the two first fastening grooves extend upward to two opposite sides of the top surface of the insulating housing, respectively, lower portions of the fronts of the two first fastening grooves extend downward to two opposite sides of a bottom surface of the insulating housing, respectively, the two first bending plates of the two buckling elements are assembled in the upper portions of the fronts of the two first fastening grooves, respectively, the two second bending plates of the two buckling elements are assembled in the lower portions of the fronts of the two first fastening grooves, respectively.

8. The flexible circuit board connector as claimed in claim 6, wherein rear edges of the two base plates of the two buckling elements are bent outward and perpendicular to the two base plates of the two buckling elements to form two soldering plates, respectively, middles of rears of the two first fastening grooves extend outward to form two second fastening grooves penetrating through the rear surface and middles of two side surfaces of the insulating housing, and front surfaces of outer walls of the two first fastening grooves, the two soldering plates of the two buckling elements project beyond the rear surface of the insulating housing through the two second fastening grooves, respectively.

9. The flexible circuit board connector as claimed in claim 8, wherein rear surfaces of the soldering portions of the plurality of the conductive terminals are flush with rear surfaces of the two soldering plates of the two buckling elements.

10. The flexible circuit board connector as claimed in claim 1, wherein two opposite sides of a top surface of a bottom wall of the opening protrude upward to form two protruding blocks, middles of the two protruding blocks open two circular pivoting holes extending transversely, the locking board has a base board of a substantially rectangular board shape, two opposite sides of the base board extend downward to form two side boards, middles of the two side boards open two perforations, respectively, two opposite ends of the pivoting rod are pivotally assembled to the pivoting holes, the two opposite ends of the pivoting rod pass through and project out of the pivoting holes, the two opposite ends of the pivoting rod projecting out of the pivoting holes pass through the two perforations respectively to make that the locking board is pivotally mounted to the pivoting rod.

11. The flexible circuit board connector as claimed in claim 10, wherein a middle of the top surface of the bottom wall of the opening is recessed downward to form a long and narrow lower accommodating groove extending transversely, the lower accommodating groove is located between the two protruding blocks, a middle of a bottom surface of the base board is recessed inward to form a long and narrow upper accommodating groove extending transversely, the upper accommodating groove is corresponding to the lower accommodating groove, an upper half of the pivoting rod is accommodated in the upper accommodating groove, a lower half of the pivoting rod is accommodated in the lower accommodating groove, the pivoting rod is accommodated between the upper accommodating groove and the lower accommodating groove.

12. The flexible circuit board connector as claimed in claim 11, wherein the bottom wall of the opening opens at least one holding groove which includes two first holding grooves located in front of the lower accommodating groove, and a second holding groove located behind the lower accommodating groove, the two first holding grooves are communicated with the second holding groove by the lower accommodating groove to form the at least one holding groove, two sides of the one end of the at least one torsion spring are elastically received in the two first holding grooves respectively and elastically abut against a front of the bottom surface of the base board of the locking board, the other end of the at least one torsion spring is accommodated in the second holding groove and disposed under a rear of the bottom surface of the base board of the locking board.

13. The flexible circuit board connector as claimed in claim 12, wherein the rear of the bottom surface of the base board of the locking board is located on a rear of the top surface of the bottom wall of the opening, so that the locking board is mounted to the insulating housing, and a top surface of the locking board is flush with the top surface of the insulating housing.

14. The flexible circuit board connector as claimed in claim 12, wherein the elastic module includes two torsion springs pivotally mounted around the pivoting rod, a middle of each of the two torsion springs is pivotally mounted around the pivoting rod, the bottom wall of the opening opens two holding grooves, each of the holding grooves includes the two first holding grooves located in front of the lower accommodating groove, and the second holding groove located behind the lower accommodating groove, two sides of one end of each of the two torsion springs are elastically received in the two first holding grooves respectively and elastically abut against the front of the bottom surface of the base board of the locking board, the other end of each of the two torsion springs is accommodated in the second holding groove and disposed under the rear of the bottom surface of the base board of the locking board.

15. The flexible circuit board connector as claimed in claim 10, wherein two opposite sides of a bottom surface of the base board are recessed inward to form two avoiding grooves, the two protruding blocks are received in the two avoiding grooves, respectively.

16. The flexible circuit board connector as claimed in claim 10, wherein the two protruding blocks are located between the two receiving slots.

17. The flexible circuit board connector as claimed in claim 1, wherein front surfaces of the two locking hooks are inclined rearward from top to bottom, upper portions and lower portions of the front surfaces of the two locking hooks are shown as arc-shaped cambers.

18. A flexible circuit board connector adapted for inserting a flexible printed circuit board into the flexible circuit board connector, two opposite sides of a rear of the flexible printed circuit board opening two gaps, respectively, the flexible circuit board connector, comprising:

an insulating housing having an inserting groove formed on a front surface of the insulating housing, at least two receiving slots penetrated through a top surface of the insulating housing and communicated with the inserting groove;

a plurality of conductive terminals received in the inserting groove;

a locking board pivotally mounted to the top surface of the insulating housing, the locking board having at least two locking hooks passing through the at least two receiving slots and projecting into the inserting groove, a front surface of each of the at least two locking hooks being inclined rearward from top to bottom; and at least one torsion spring being clamped between the insulating housing and the locking board to urge the locking hooks to project into the inserting groove;

wherein the flexible printed circuit board abuts against the two locking hooks, the flexible printed circuit board pushes rearward against front surfaces of the two locking hooks to make the locking board rotate, after the flexible printed circuit board slips away from the two locking hooks, the two locking hooks project into the two gaps of the flexible printed circuit board, respectively, and when the flexible printed circuit board moves frontward, the two locking hooks are capable of abutting against rear inner walls of the two gaps of the flexible printed circuit board respectively for blocking the flexible printed circuit board from moving frontward, so that the flexible printed circuit board is locked in the inserting groove.

19. The flexible circuit board connector as claimed in claim 18, wherein the top surface of the insulating housing opens at least one holding groove, at least one portion of the at least one torsion spring is received in the at least one holding groove.

20. The flexible circuit board connector as claimed in claim 19, wherein the top surface of the insulating housing forms a concave portion for receiving the locking board and the at least one torsion spring, a top surface of the locking board is flush with the top surface of the insulating housing.

* * * * *